US005544938A

United States Patent [19]

Saul et al.

[11] Patent Number: 5,544,938

[45] Date of Patent: Aug. 13, 1996

[54] MOUNTING APPARATUS FOR SECURING INDEPENDENT SECTIONS OF A SECTIONAL SOFA ASSEMBLY

[75] Inventors: Jonathan R. Saul, LaSalle; Richard E. Marshall, Monroe; Larry P. LaPointe, Temperance, all of Mich.

[73] Assignee: La-Z-Boy Chair Company, Monroe, Mich.

[21] Appl. No.: 209,159

[22] Filed: Mar. 10, 1994

Related U.S. Application Data

[63] Continuation-in-part of Ser. No. 109,832, Aug. 20, 1993.

[51] Int. Cl.[6] ..... A47C 15/00

[52] U.S. Cl. ..... 297/248; 297/463.1; 297/85

[58] Field of Search ..... 297/440.1, 440.14, 297/233, 248, 463.1, 232, 257, 249, 85; 248/222.4, 223.1, 223.2, 501; 403/205

[56] References Cited

U.S. PATENT DOCUMENTS

| | | | |
|---|---|---|---|
| D. 83,452 | 2/1931 | Klemm et al. . | |
| D. 155,624 | 10/1949 | Pahlmann . | |
| D. 180,982 | 9/1957 | Woodward . | |
| D. 190,904 | 7/1961 | Kasparian . | |
| D. 260,058 | 8/1981 | Ponzellini . | |
| D. 265,952 | 8/1982 | Theodore . | |
| D. 268,551 | 4/1983 | Raftery et al. . | |
| D. 268,552 | 4/1983 | Raftery et al. . | |
| 797,826 | 8/1905 | Sherman, Jr. . | |
| 1,198,726 | 9/1916 | Huntley | 297/248 X |
| 1,335,842 | 4/1920 | Lambert . | |
| 2,716,775 | 9/1955 | Kenimer . | |
| 3,093,410 | 6/1963 | Wilson . | |
| 3,127,216 | 3/1964 | Clouse . | |
| 3,614,157 | 10/1971 | Hendrickson et al. | 297/248 |
| 3,620,567 | 11/1971 | Hendrickson et al. | 297/248 |
| 3,635,521 | 1/1972 | Shivvers . | |
| 3,640,569 | 2/1972 | Young . | |
| 3,731,956 | 5/1973 | Hanley | 248/223.1 X |
| 3,841,701 | 10/1974 | Sullivan . | |
| 3,893,729 | 7/1975 | Sherman et al. . | |
| 3,944,281 | 3/1976 | Piretti | 297/248 X |
| 4,077,666 | 3/1978 | Heumann | 297/248 X |
| 4,102,587 | 7/1978 | Herb et al. | 408/205 |
| 4,114,947 | 9/1978 | Nelson . | |
| 4,258,464 | 3/1981 | Ullman, Jr. | 248/222.4 X |
| 4,311,337 | 1/1982 | Brunn . | |
| 4,395,071 | 7/1983 | Laird . | |
| 4,434,900 | 3/1984 | Cook | 248/222.4 X |
| 4,476,984 | 10/1984 | Garrett | 248/222.4 X |
| 4,595,164 | 6/1986 | Froutzis et al. . | |
| 4,668,011 | 5/1987 | Fister, Jr. | 297/248 X |
| 4,740,031 | 4/1988 | Rogers, Jr. . | |
| 4,848,839 | 7/1989 | Galardo . | |
| 4,848,843 | 7/1989 | Gibbs . | |
| 5,234,253 | 8/1993 | LaPointe et al. . | |
| 5,352,017 | 10/1994 | Berning | 297/248 |

FOREIGN PATENT DOCUMENTS

| | | | |
|---|---|---|---|
| 221202 | 10/1957 | Australia | 248/222.4 |

*Primary Examiner*—Milton Nelson, Jr.
*Attorney, Agent, or Firm*—Harness, Dickey & Pierce, P.L.C.

[57] ABSTRACT

A mounting apparatus and method for releasably securing together adjacent seating sections wherein the mounting apparatus includes a bracket having a key-hole like opening formed therein and a fastener having an enlarged head and a shaft. The mounting apparatus is disposed between a first and second seating section such that the enlarged head and a portion of the shaft extend through the key-hole like opening and engaged the bracket to releasably secure together the adjacent seating sections to form the modular sofa assembly.

13 Claims, 9 Drawing Sheets

FIG 1
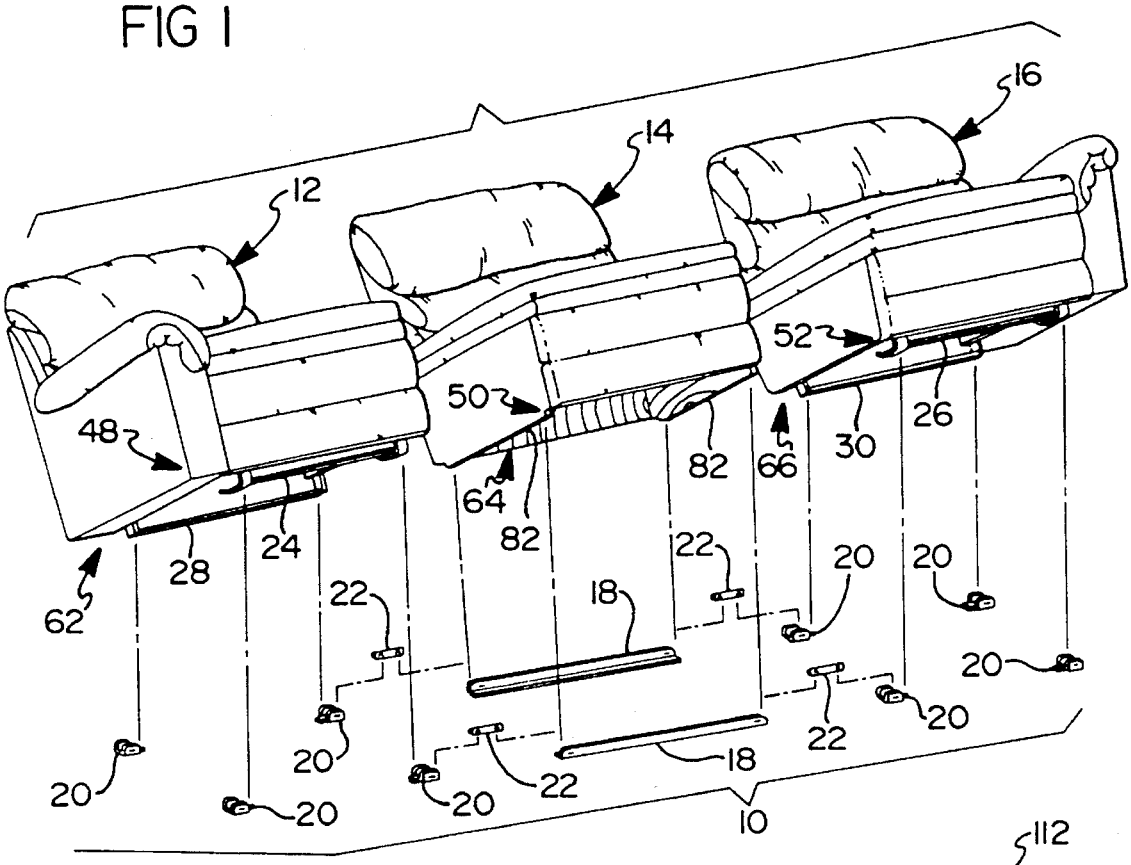
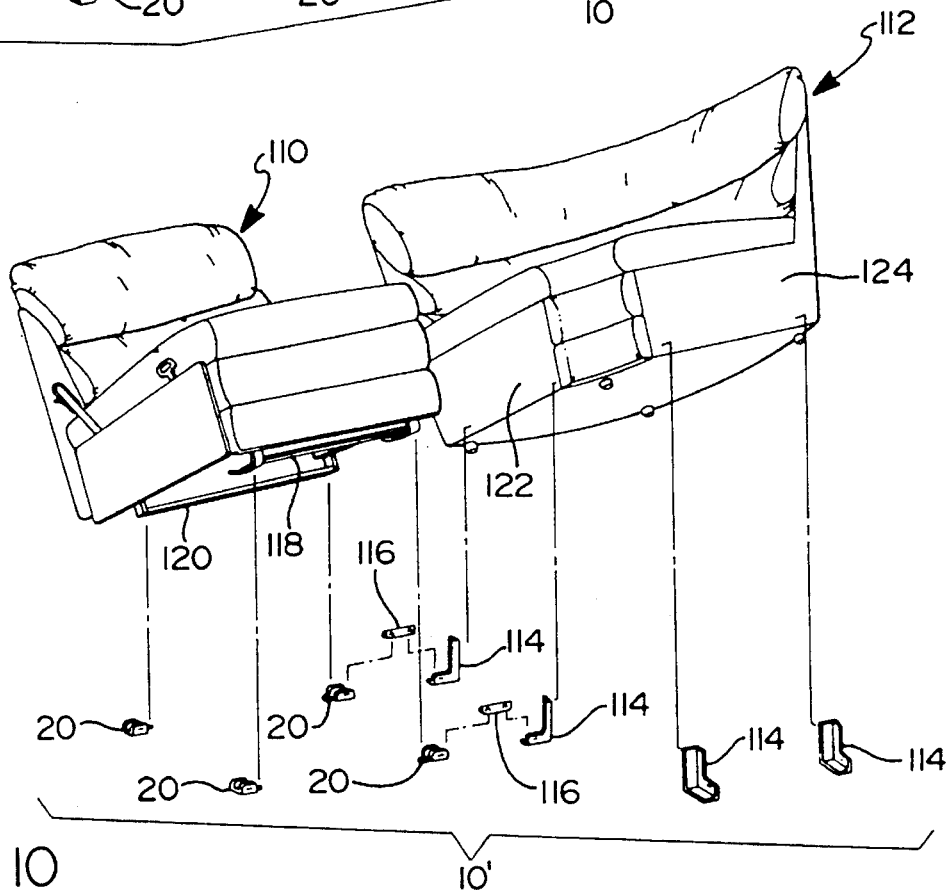
FIG 10

18
20
22
24
28
32
34
36
38
40
42
44
46
54
56
58
60
68
70
72
74
78
80
92
94
96

FIG 11
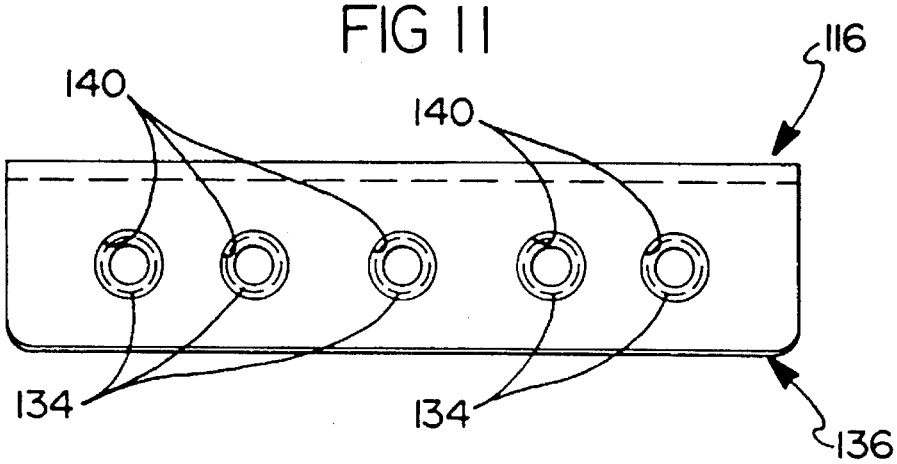
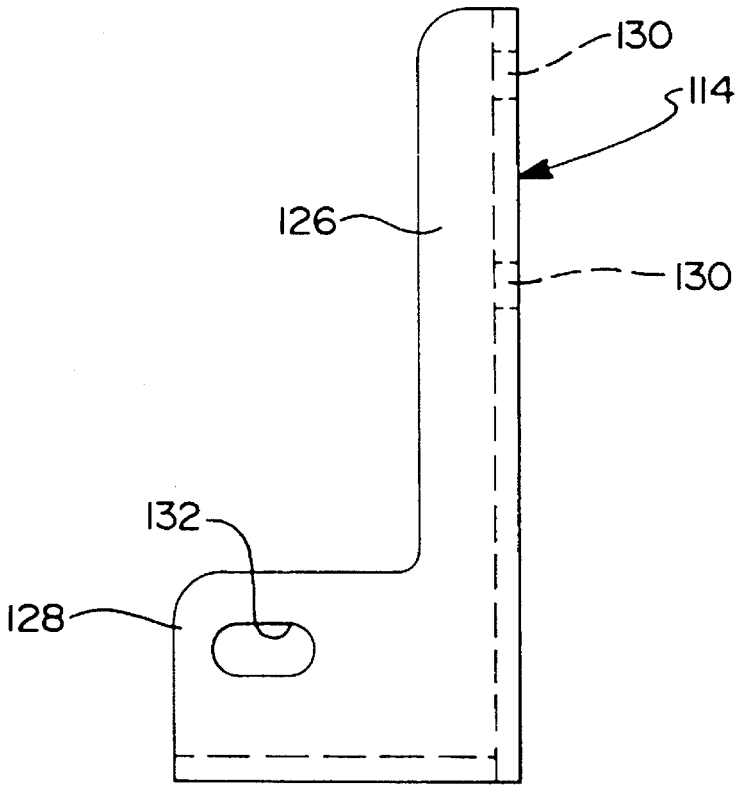
FIG 12

14
14
100
44
92
132
114
18
116
134
20
46
60
26
24
136
138
140

FIG 15
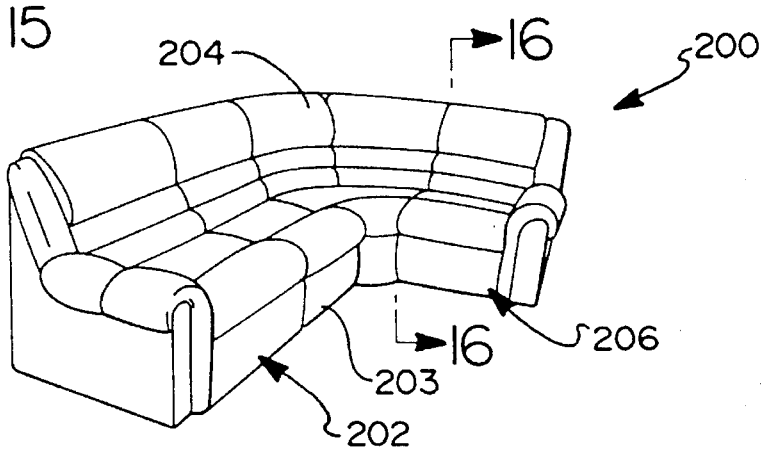
FIG 16
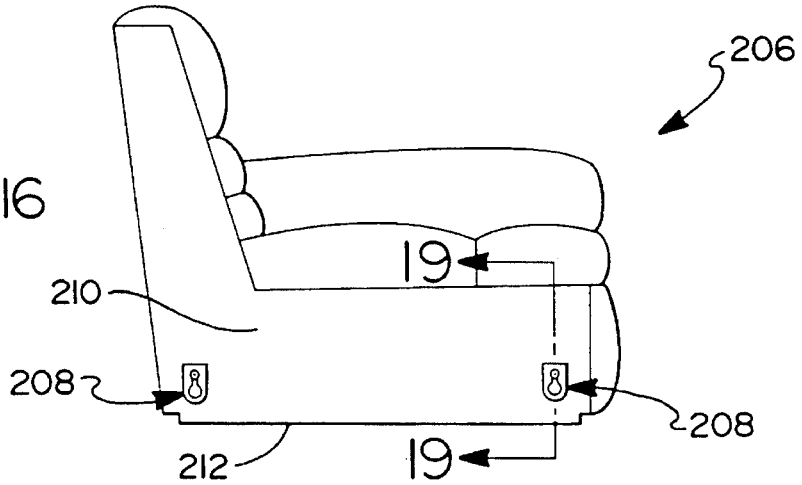
FIG 19
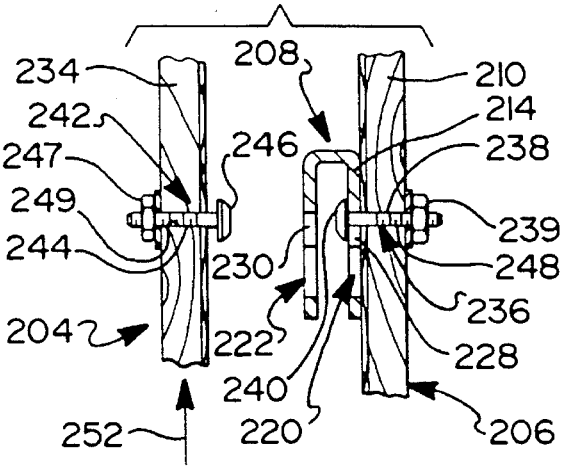
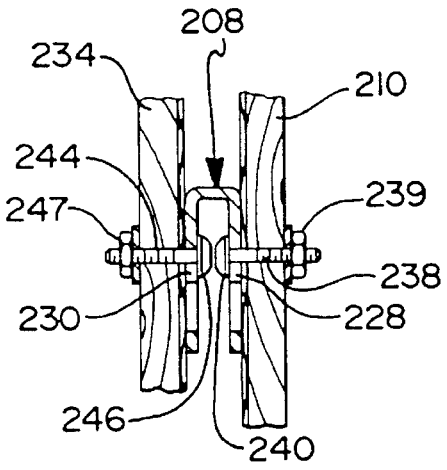
FIG 20

FIG 17
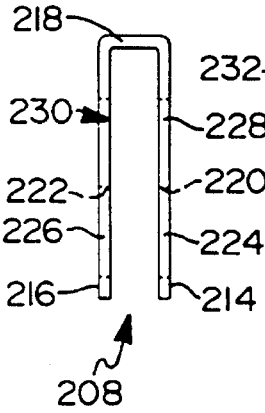
FIG 18A
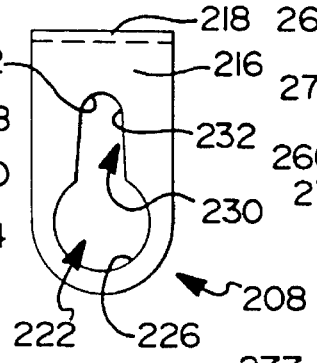
FIG 21
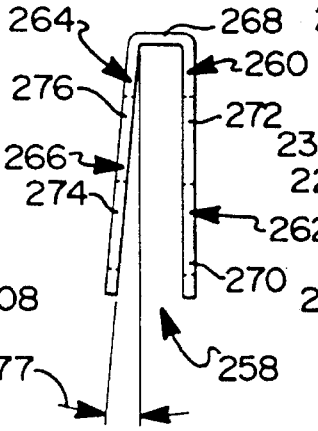
FIG 18B
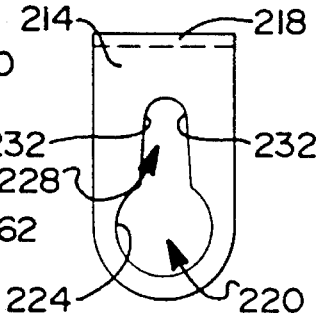
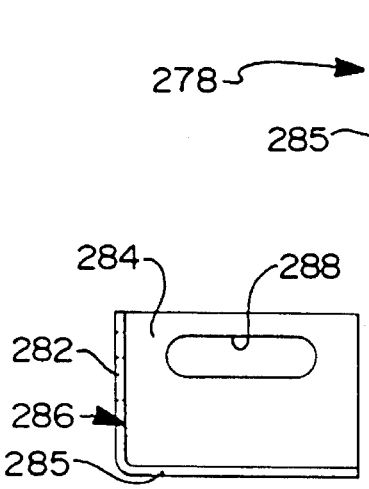
FIG 25
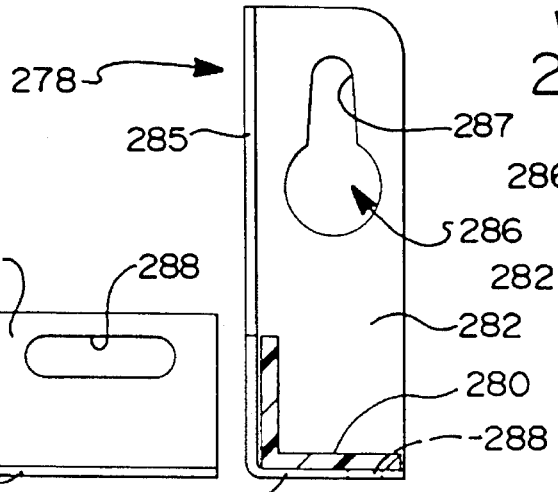
FIG 24
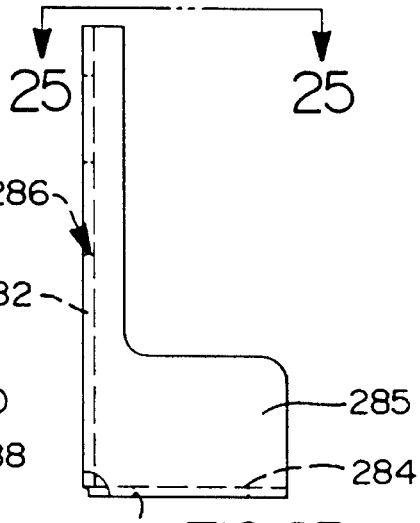
FIG 23
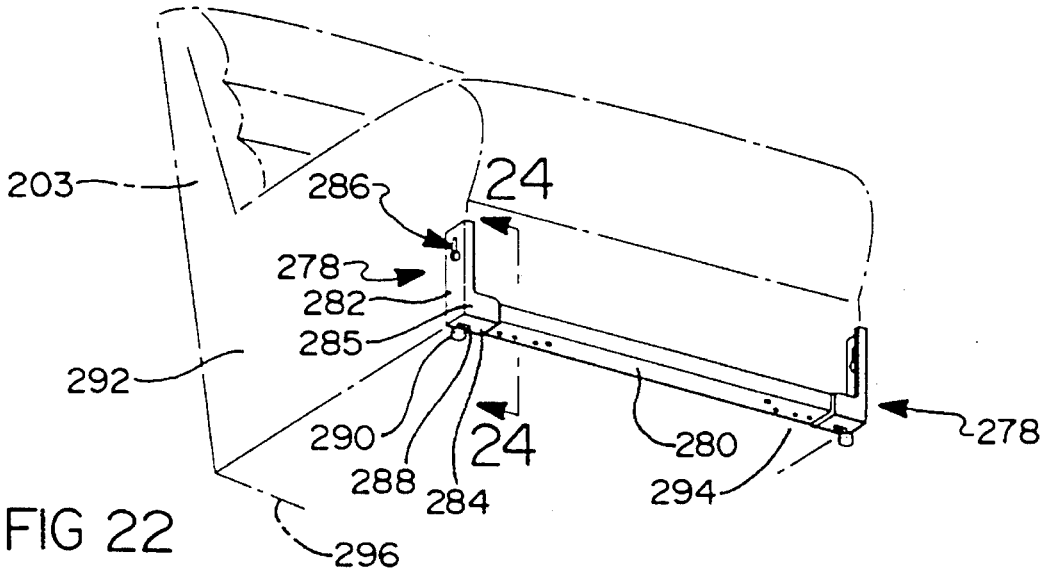
FIG 22

MOUNTING APPARATUS FOR SECURING INDEPENDENT SECTIONS OF A SECTIONAL SOFA ASSEMBLY

CROSS-REFERENCE TO RELATED APPLICATION

This application is a continuation-in-part of U.S. patent application Ser. No. 08/109,832, filed Aug. 20, 1993, entitled MOUNTING APPARATUS FOR A MODULAR SOFA ASSEMBLY, currently pending.

BACKGROUND OF THE INVENTION

1. Technical Field

The present invention relates to furniture and, more particularly, to a mounting apparatus for removably securing a plurality of independent seating sections together in a side-by-side configuration in modular fashion to form a loveseat, sofa or the like.

2. Discussion

Present day sofas now often incorporate one or more seating sections which function as recliners to provide a significant degree of added comfort when compared with many conventional sofas incorporating a single fixed seating arrangement. Such sofa assemblies incorporating one or more recliner seating sections enable the owner to "customize" a sofa assembly to fit her/his specific needs and lifestyle.

With sofa assemblies as described above, it has heretofore been necessary to secure the recliner section(s) of the sofa together with the remaining seating section(s) via use of a permanent frame, usually constructed integrally with the various seating sections at the factory. Accordingly, when the sofa assembly is shipped it must be shipped as one single, relatively large structure.

While the permanent frame has proved to provide good structural strength to the sofa assembly, it would be desirable to provide removable frame-like apparatus to secure the various sections of a modular sofa assembly together after the assembly has reached its destination. This would significantly ease the shipping and handling of such sofa assemblies as the various components thereof could be shipped and handled independently. At the destination, the ability to individually handle the components of the sofa assembly would contribute to much easier handling of the sofa assembly when transporting it, for example, within hallways and through doorways of rooms in a home, apartment or even an office. By being able to handle individual sections of a sofa assembly independently, the entire sofa assembly is capable of being handled and transported through such areas where the completely assembled sofa assembly might be too large and cumbersome to handle or transport. In addition, it is often desirable to include three or more reclinable seating units in a sofa assembly. The added weight of these additional recliner units would make a typical sofa heavy and difficult to handle and transport, whereas the individual seating units are easily handled and transported if detached from the sofa assembly.

It would further be desirable if such a frame-like mounting apparatus as described above incorporated some means for enabling the modular sections of the sofa assembly to be laterally adjusted to compensate for slightly varying thicknesses of fabric and padding. The need for allowing some adjustability in a frame-like mounting apparatus as described above is particularly acute when one or more recliner chair sections are included to form the modular sofa assembly. The recliner sections must be able to recline freely with a minimum amount of friction from adjacent stationary seating sections, and yet the clearance between the recliner sections and other sections of the sofa assembly must not be so great as to allow unnecessary gap clearance between adjacent seating sections of the sofa assembly. Such a mounting apparatus is disclosed in the commonly assigned U.S. Pat. No. 5,234,253, the disclosure of which is hereby expressly incorporated herein by reference.

The advantage of such a frame-like mounting apparatus as described in the above referenced U.S. Patent is the flexibility in changing the configuration of the sofa assembly as the needs of the owner change. For example, if the sofa assembly was originally purchased with three sections, the owner could at a later time eliminate the center section and reinstall the two other sections on shorter frame rails to achieve a loveseat configuration. Accordingly, there would be no need for the owner to order an entire new sofa assembly comprising only two sections if the owner desired to utilize the sofa in a location with space restrictions or for other reasons.

It is therefore a principal object of the present invention to provide a mounting apparatus for a modular sofa assembly which may be removably secured to the various seating sections of the sofa assembly at the factory or at the destination where the sofa assembly is to be installed.

It is still a further object of the present invention to provide a mounting apparatus which may be secured to various sections of a modular sofa assembly quickly, easily and without any special tools.

It is yet another object of the present invention to provide a mounting apparatus which incorporates means for adjustably positioning adjacent seating sections of a modular sofa assembly to thereby compensate for varying thicknesses in fabric, cushioning, etc. of the various seating sections.

It is still another object of the present invention to provide a mounting apparatus for a modular sofa assembly which enables a particular seating section, for example, a fixed seating section to be detached from the apparatus and substituted with another seating section, for example, a reclining seating section.

It is yet another object of the present invention to provide a mounting apparatus which may be easily and conveniently shipped and handled together with independent seating sections to which the apparatus is ultimately to be secured.

It is still another object of the present invention to provide a mounting apparatus which is very inexpensive to produce and which does not add appreciably to the overall complexity of the modular sofa assembly or its assembly.

SUMMARY OF THE INVENTION

The above and other objects are accomplished by a bracket apparatus and method of using same in accordance with the preferred embodiments of the present invention. In one preferred embodiment of the bracket apparatus a generally U-shaped bracket is provided having a first wall portion and a second wall portion. The first wall portion includes a key-hole like opening and the second wall portion includes a separate opening therein. A first fastener having an elongated shaft and an enlarged head portion is secured to a side wall of a first modular seating section so as to protrude generally perpendicularly outwardly therefrom. A second fastener is included for securing the second wall portion to a second modular seating section such that the first wall portion of the bracket apparatus extends generally parallel to the side wall of the first modular seating section.

The first and second seating sections are secured together by positioning the second seating section such that the enlarged head portion of the fastener protrudes through the key-hole like opening in the first wall portion of the bracket. One of the other of the two seating sections is then urged laterally of the other so as to urge the enlarged head portion of the fastener into a slot of the key-hole like opening, thus releasably securing the two seating sections closely adjacent one another in a side-by-side fashion.

In one preferred embodiment the bracket apparatus comprises a generally U-shaped bracket having the second wall portion disposed generally parallel to the first wall portion. In this embodiment the opening formed in the second wall portion also comprises a key-hole like opening adapted to receive a second fastener secured to, and protruding outwardly from, a side wall of the second seating section. Accordingly, seating sections that incorporate no frame rails or other like structure can easily, quickly and conveniently be releasably secured together in side-by-side fashion to form a modular seating unit.

In an alternative preferred embodiment of the bracket apparatus, the second wall portion protrudes generally perpendicularly from the first wall portion and the opening formed in the second wall portion comprises an elongated slot. The second wall portion is particularly well adapted to be secured to a frame rail of a recliner seating section in a manner that disposes the first wall portion generally parallel to the side wall of the first seating section. In this embodiment a connecting wall portion integrally formed with the first and second wall portions is preferably included for adding even further structural rigidity and strength to the bracket apparatus. The elongated shape of the slot in the second wall portion allows the bracket to be adjustably positioned relative to the frame rail of the second seating section to thereby add a degree of adjustability to the spacing between the first and second seating sections when the seating sections are releasably secured together by their bracket apparatus. Accordingly, this allows the spacing to be adjusted such that a recliner, having fabric covered components which must move freely, may be adjustably positioned next to a fixed seating section, or even another recliner section, to allow the recliner seating section to operate freely without interference from the adjacent seating section.

The preferred embodiments of the present invention provide a very cost effective yet simple to manufacture means by which one or more modular seating sections, whether they be fixed or recliner seating sections, can be quickly and easily secured together to form a modular seating assembly. The preferred embodiments further provide for a small degree of adjustability between the spacing of the seating sections as well as allowing the seating sections to be quickly and easily uncoupled from one another. In this manner the individual seating sections of a modular seating assembly may be quickly and easily secured to one another by relatively unskilled personnel, such as when the seating assembly is delivered to a home, office, etc. The preferred embodiments of the present invention further enable the individual seating sections of a modular seating assembly to be quickly and easily detached from one another if the seating assembly is to be moved.

It will be appreciated, then, that the preferred embodiments disclosed herein provide a significant advantage in that the seating assembly may be much more easily shipped and handled than if the assembly was secured together at a factory, dealership, etc. The preferred embodiments further do not require any special tools to enable the bracket members and fastening members to be secured to the seating sections of the modular sofa seating assembly.

BRIEF DESCRIPTION OF THE DRAWINGS

The various advantages of the present invention will become apparent to one skilled in the art by reading the following specification and subjoined claims and by referencing the following drawings in which:

FIG. 1 is an exploded perspective view of a modular sofa assembly in accordance with a first preferred embodiment of the invention showing how three independent seating sections may be alignably configured together in a side-by-side arrangement and removably secured together via frame rails, connecting feet and connecting links;

FIG. 10 is a view similar to FIG. 1, showing the interconnection of an independent reclinable seating section with a corner seating section in side-by-side arrangement and removably secured together via connecting feet and angle brackets according to a second preferred embodiment of the invention;

FIG. 11 is a front elevational view of a connecting link according to a second preferred embodiment of the invention;

FIG. 12 is a front elevational view of an angle bracket of the invention;

FIG. 15 is perspective view of a modular seating assembly in the form of a modular sofa showing a corner section, a fixed seating section releasably secured to one side of the corner section and a fixed seating section and recliner seating section on the opposite side of the corner section;

FIG. 16 is a side view of the end seating section shown in FIG. 15 in accordance with section line 16—16 in FIG. 15 showing two of the bracket members in accordance with one preferred embodiment of the present invention positioned thereon;

FIG. 17 is an end view of the bracket member shown in FIG. 16;

FIG. 18*a* is a side view of the bracket member of FIG. 17;

FIG. 18*b* is a view of the opposite side of the bracket member shown in FIG. 18*a;*

FIG. 19 is a cross sectional view of a portion of the seating section shown in FIG. 16, in accordance with section line 19—19, and a portion of a sidewall of the corner seating section showing the two seating sections about to be secured together by the bracket member of the present invention;

FIG. 20 is a view of the sidewalls of the fixed seating sections shown in FIG. 19 after having been secured to one another by one of the bracket members and fasteners of the present invention;

FIG. 21 is an end view of an alternative preferred embodiment of the present invention;

FIG. 22 is a perspective view of the recliner seating section shown in FIG. 15 illustrating one of a pair of frame rails which is typically used to help support the recliner mechanism of the chair and a pair of bracket members in accordance with another alternative preferred embodiment of the present invention secured to the front frame rail;

FIG. 23 is a front view of one of the bracket members shown In FIG. 22;

FIG. 24 is a side view of the bracket member of FIG. 22 taken in accordance with directional line 24—24 in FIG. 22;

FIG. 25 is a side view of the bracket member of FIGS. 22–24 in accordance with directional line 25—25 in FIG. 23;

DETAILED DESCRIPTION OF THE PREFERRED EMBODIMENTS

Figures 2A, 2B, 2C, 3:
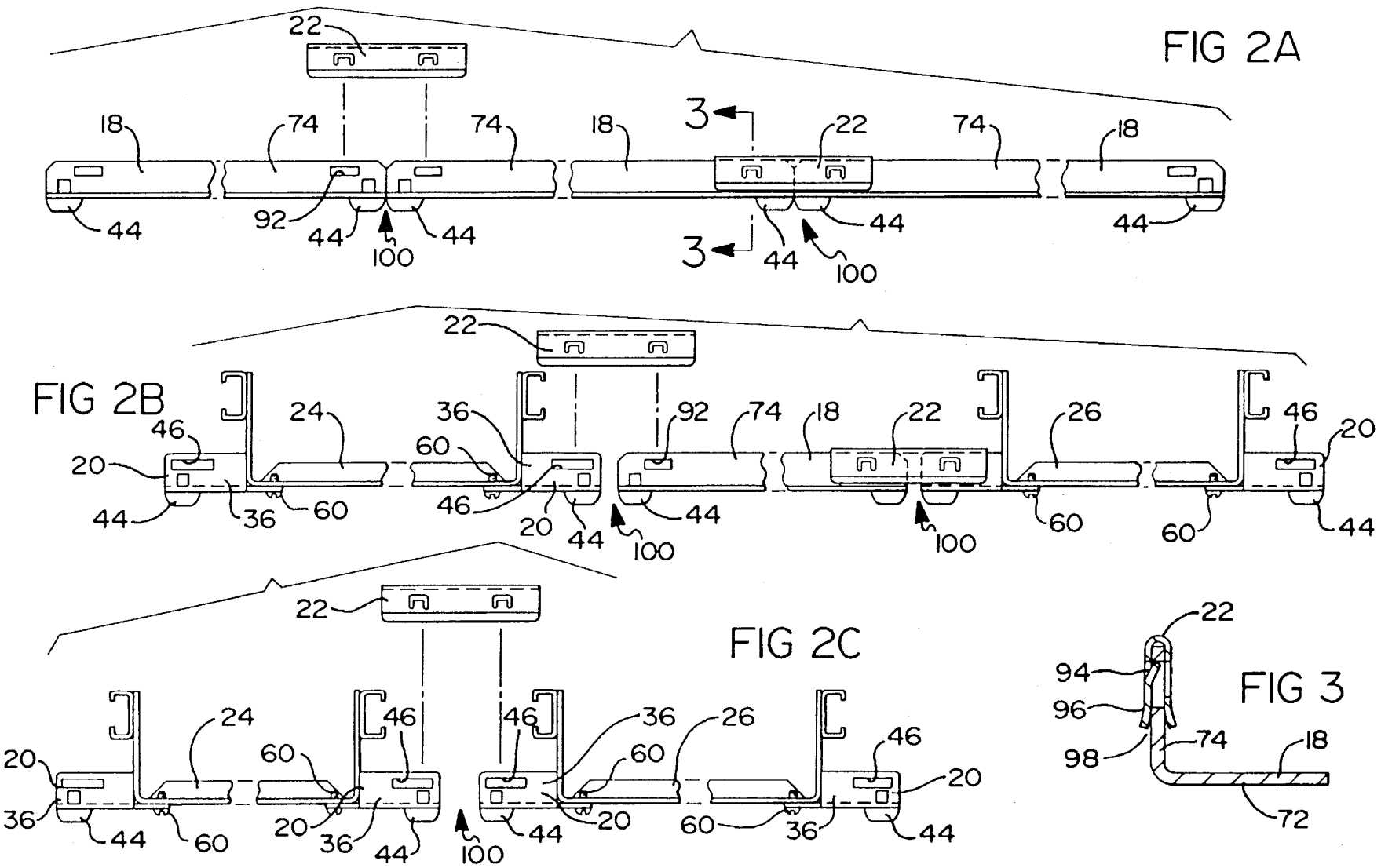
FIGS. 2A–2C are partial schematic front views of exemplary arrangements of frame rails, connecting feet and connecting links according to a first preferred embodiment of the invention.
FIG. 3 is a section view as indicated by line 3—3 in FIG. 2A showing the engagement of the connecting link with a connecting rail.

In accordance with the teachings of the present invention, a mounting apparatus particularly well-suited for removably securing a plurality of recliner sections together to form a modular sofa assembly is disclosed. It should be understood from the outset that the mounting apparatus of the present invention is readily adaptable to any number of types of seating units including those disclosed in the commonly assigned U.S. Pat. No. 5,141,284; U.S. Pat. No. 5,234,253 and U.S. patent application Ser. No. 08/040,004 filed Apr. 9, 1993, the disclosures of which are hereby expressly incorporated herein by reference.

Referring to FIG. 1, a mounting apparatus 10 in accordance with a first preferred embodiment of the present invention is shown. Also shown are a plurality of independent, modular seating sections 12, 14 and 16, with seating sections 12 and 16 being of the recliner type and having recliner mechanisms like that disclosed in the aforesaid U.S. Pat. No. 5,141,284. The mounting apparatus 10 of the present invention generally comprises a plurality of frame rails 18 and connecting feet 20 secured to seating units 12–16, the frame rails and/or connecting feet which are interconnected by connecting links 22.

Figures 4, 5, 6, 7, 8:
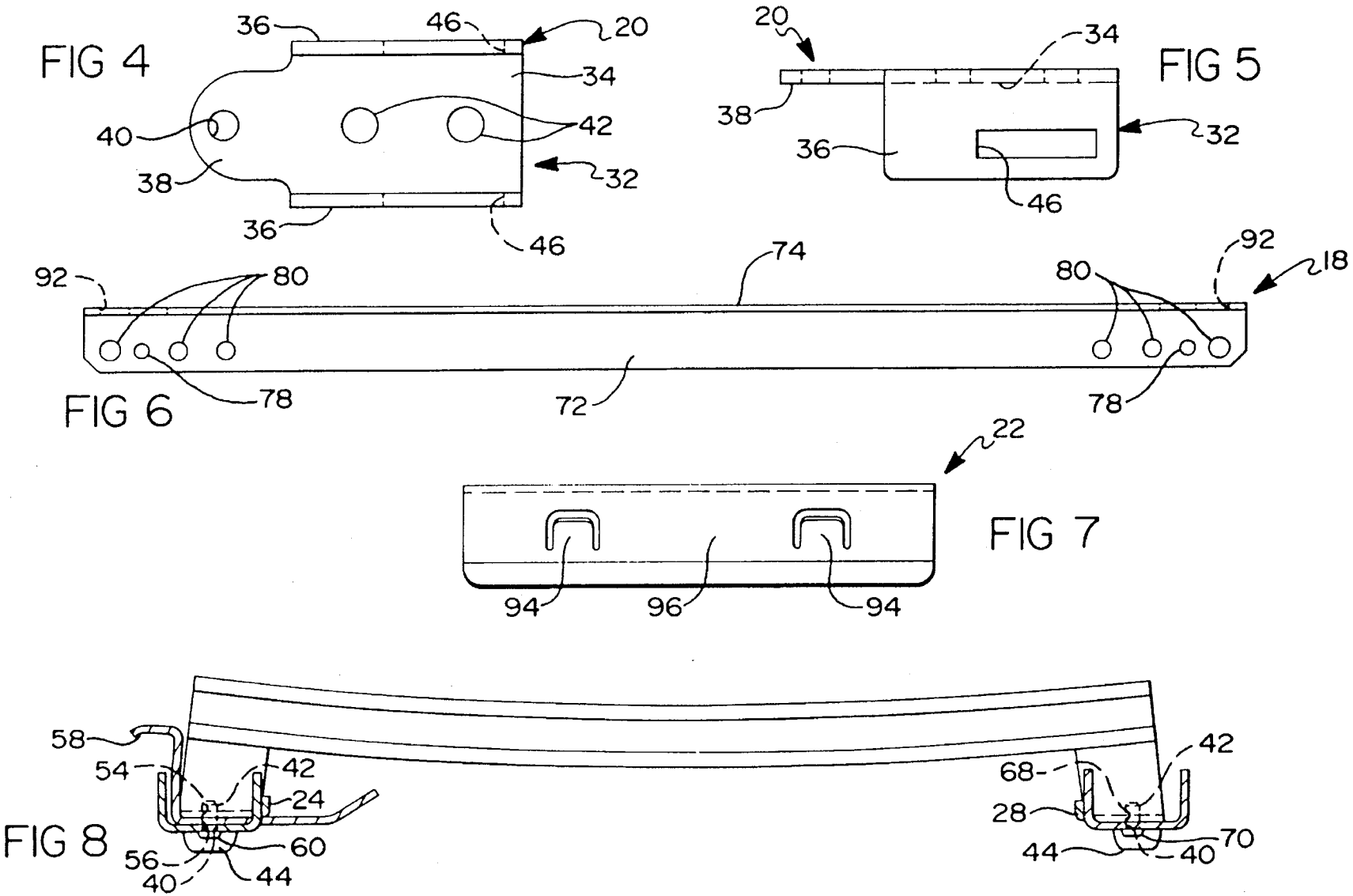
FIG. 4 is a top view of a connecting foot of the invention.
FIG. 5 is a side view of a connecting foot.
FIG. 6 is a top view of frame rail.
FIG. 7 is a front view of a connecting link.
FIG. 8 is a side elevational view showing the assembly of the connecting feet to the channel tracks of a recliner seating section.

With reference to FIGS. 4 and 5, a connecting foot 20 particularly adapted to be secured to seating units having front and rear cross bars such as cross bars 24, 26 and 28, 30 of seating units 12 and 16, respectively, is shown. Connecting foot 20 includes a generally U shaped portion 32 including a base portion 34, extending leg members 36, and an outwardly extending mounting tab 38. Mounting tab 38 is formed with an aperture 40 for detachably mounting connecting foot 20 to a seating unit and threaded apertures 42 formed in base portion 34 are provided for receiving foot member 44, best seen in FIG. 8. Foot members 44 are adjustably received in threaded apertures 42 formed in connecting feet 20 and frame rails 18. In the preferred embodiment, a foot member 44 is provided at each corner of seating units 12–16. As stated, foot members 44 are adjustably received in threaded apertures 42 and thus may be adjusted to prevent bowing of the sofa or loveseat unit under the weight of the occupants. In addition, a slight amount of positive bow may be provided such that the sofa or loveseat unit deflects to a substantially flat position under the weight of occupants.

With reference once again to FIGS. 4 and 5, elongated apertures 46 formed in leg members 36 are provided for releasably engaging connecting links 22 and interconnecting seating units 12–16 as will be explained. As can be seen in FIG. 8, connecting feet 20 are detachably mounted to forward portions 48 and 52 of seating units 12 and 16 via threaded apertures 54, 56 formed in cross-bar 24 and mounting/stop bracket 58, respectively, connecting foot threaded aperture 42 and threaded screw 60. At the rearward portions 62 and 66 of seating units 12 and 16, connecting feet 20 are detachably mounted to cross-bar 28 via a threaded aperture 68 formed in cross-bar 28, connecting foot threaded aperture 42 and threaded screw 70. As will be appreciated, connecting feet 20 are attached at each end of the front and rear cross bars in substantially identical manner and therefore four connecting feet 20 are used per seating unit. In addition, it is preferable that connecting feet 20 be attached at the factory thus minimizing the amount of assembly required by the owner.

Figure 9:
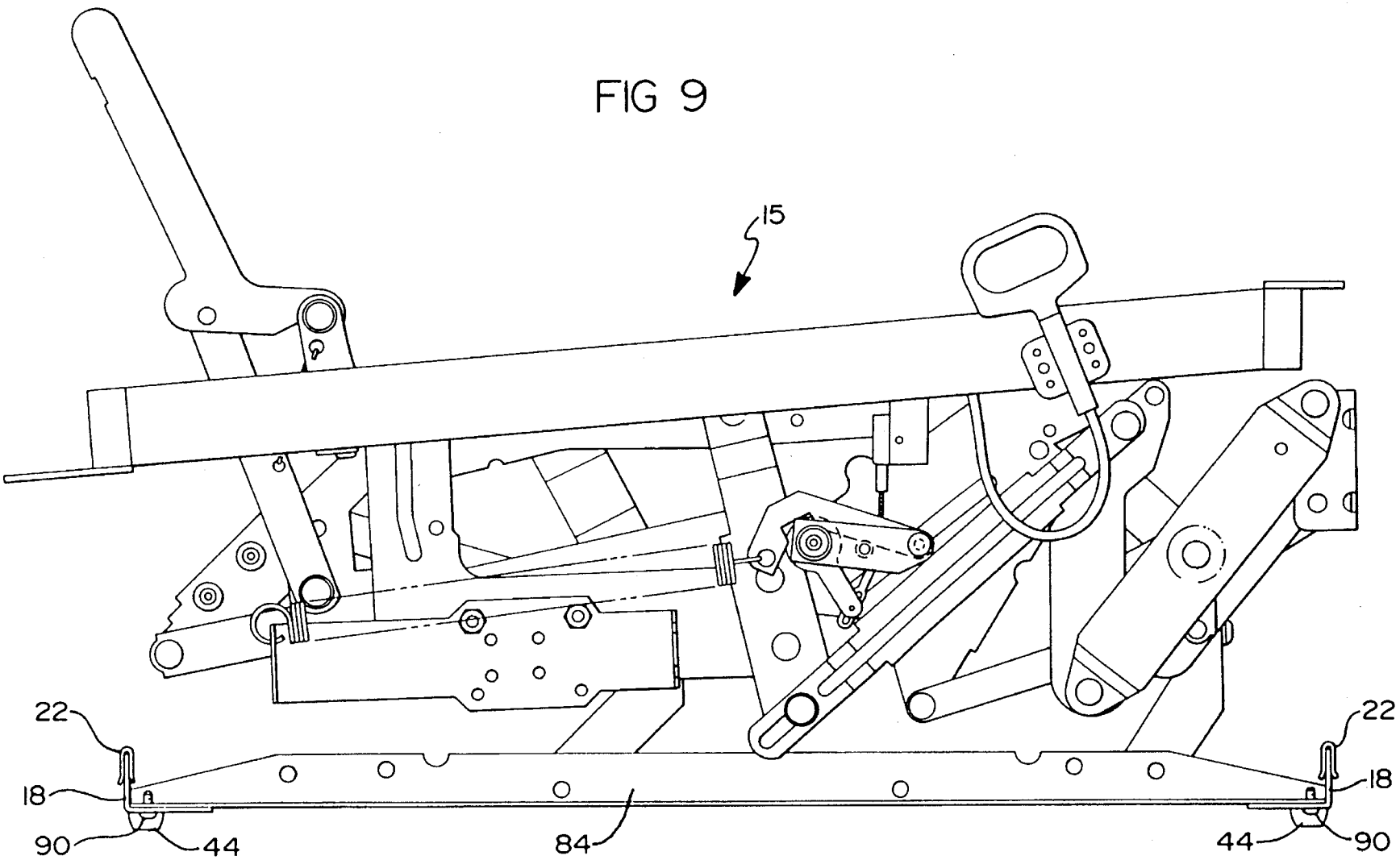
FIG. 9 is a side elevational view of a reclining seating unit mechanism showing the assembly of the frame rails to the recliner mechanism base.

Referring to FIG. 6, frame rail 18 is an elongated L shaped member having a base leg 72, an upstanding leg 74 and a plurality of mounting apertures 78 for detachably mounting frame rail 18 to seating unit 14 and a plurality of threaded apertures 80 for receiving foot members 44 as described and as best seen in FIGS. 2A and 2B. Frame rail 18 in length is approximately the width of a seating unit to which it is mounted and is adapted to span the distance between, for example, side edge portions 82 of fixed seating unit 14 or lower frame portions 84 of reclinable seating unit 15 shown in FIG. 9 and which seating unit is more completely described in the aforementioned U.S. patent application Ser. No. 08/040,004. On a non-reclinable seating unit such as shown in FIG. 1, frame rail 18 may be connected to side portions 82 via frame rail apertures 78 and suitable threaded fastener means such as threaded screws. Similarly, frame rails 18 may be connected to lower frame portions 84 of reclinable seating unit 15 via threaded apertures (not shown) formed in lower frame portion 84, frame rail threaded apertures 78 and threaded screws 90. Frame rail 18 is further provided on each end of upstanding leg 74 with elongated apertures 92 for releasably engaging connecting links 22. It should be understood that frame rails 18 and connecting feet 20 are constructed from steel or other material having relatively good structural strength and rigidity. It should be further understood that frame rails 18 are connected at both the front and rear portions of the seating units which attachment is preferable completed at the factory.

With reference to FIGS. 3 and 7, connecting link 22 is shown having a generally U shaped cross section and at least two inwardly deflecting locking tabs 94 formed in a side wall portion 96. Preferably, connecting link 22 is formed from resilient spring steel with an opening 98 slightly less than the thickness of connecting feet leg members 36 and frame rail upstanding leg member 74 for providing a snug fitting engagement. Opening 98 is also advantageously flanged slightly more open at its end for facilitating engagement of connecting link 22 with connecting feet 20 and frame rail 18. It should be reiterated that connecting feet 20 and frame rails 18 are preferably assembled to seating units 12–16 at the factory, and then connected via connecting links 22 at the distributor's showroom or, more preferably, at the customer's home or office to link the seating units and form the sofa or loveseat.

With reference then to FIGS. 2A–2C, the manner in which seating units 12–16 are alignably coupled to form a sofa or loveseat is shown. FIG. 2A schematically illustrates the mounting apparatus 10 for interconnecting seating units without front and rear cross bars such as fixed seating unit 14 or reclinable seating unit 15 to form a sofa. As described, frame rails 18 are detachably mounted to, for example, side edge portions 82 of fixed seating unit 14. The seating units are then aligned proximately adjacent each other in side-by-side relationship as shown schematically by the arrangement of frame rails 18. Connecting links 22 are pressed down over frame rail upstanding leg portion 74 of each frame rail 18 associated with the adjacent seating units to be joined. As best seen in FIG. 3, when seated over leg portion 74, connecting link tabs 94 engage elongated apertures 92 of adjacent frame rails 18 secured to adjacent seating units thereby lockingly securing connecting link 22 to frame rails 18. Connecting links 22 are similarly connected to frame rails 18 at each interface 100 of adjacent seating units thereby rigidly linking the seating units together.

As previously indicated, an important object of the present invention is providing adjustability between adjacent seating sections joined to form a sofa or loveseat. The adjustment of the adjacent seating units allows for positioning the seating units closely enough together so as to provide a comfortable, continuous and aesthetically pleasing seating surface while still providing enough clearance for smooth operation of any reclining units incorporated into the sofa. In this regard, frame rail elongated apertures 92 are approximately about ¾" in length while connecting link tabs 94 are approximately about ⅜" in length. As will be appreciated, this arrangement conveniently provides for about ¾" of side to side lateral adjustment between the two adjacent seating units.

FIG. 2B schematically illustrates the mounting apparatus 10 for interconnecting a pair of seating units having front and rear cross bars, such as reclining seating units 12 and 16, to a center seating unit which does not have front and rear cross bars, such as fixed seating unit 14 or reclining seating unit 15. In this arrangement, connecting feet 20 are detachably secured to front and rear cross bars 24, 26 and 28, 30 of seating units 12 and 16, respectively as previously described. Frame rails 18 are detachably secured to the center seating unit and the seating units are arranged as shown schematically in FIG. 2B in proximate side-by-side relationship. Connecting links 22 are pressed down over frame rail upstanding leg 74 and connecting foot leg member 36 with connecting link tabs 94 engaging frame rail elongated aperture and connecting foot elongated aperture 92 and 46, respectively, to rigidly, yet detachably, secure the seating units together to form a sofa.

As discussed, elongated apertures 92 and 46 of frame rails 18 and connecting feet 20, respectively, and connecting link locking tabs 94 provide means for adjusting the side-by-side relationship of adjacent seating units. Connecting foot elongated aperture 46 is approximately about 1-⅛" in length. Therefore, the above interconnection provides approximately 1-⅛" of side-by-side adjustment between a seating unit adapted with connecting feet 20 and a seating unit adapted with frame rails 18.

Similar to the above arrangements, FIG. 2C illustrates the mounting apparatus 10 for interconnecting a pair of seating units having front and rear cross bars. In this case, connecting feet 20 are detachably secured to the front and rear cross bars, such as front and rear cross bars 24, 26 and 28, 30 of reclinable seating units 12 and 16. As with the other interconnection arrangements, the seating units are aligned in close side-by-side relationship. Connecting links 22 are then pressed over connecting feet leg members 36 at each interface 100 of adjacent seating units with tabs 94 engaging connecting feet elongated apertures 46 to rigidly, yet detachably, interconnect the seating units.

As stated above the connecting links provide a rigid, yet detachable, interconnection of seating units. This important feature of the present invention provides for simply and easily disconnecting the seating units for rearranging, transporting, or storing the sofa or loveseat assembly. Connecting links 22 rigidly secure the seating units together by snugly fitting over frame rail upstanding leg member 74 and connecting feet leg members 36 and by locking tabs 94 engaging frame rail elongated apertures 92 and connecting feet elongated apertures 46. Connecting links 22 may be removed by simply deflecting locking tab 94 out of engagement with elongated apertures 92, 46 and sliding connecting link 22 off of the frame rail 18 or connecting foot 20, respectively. Locking tab 94 can easily be deflected by inserting a standard head screw driver or other suitable flat object between connecting link 22 and frame rail 18 or connecting foot 20 and thereby deflecting locking tab 94. Thus, the present invention provides quick and simple means for both assembling and disassembling a sofa or loveseat assembly allowing the owner to create numerous varying configurations of independent seating units.

With reference to FIG. 10, a mounting apparatus 10' is shown interconnecting a reclinable seating unit 110 with a corner seating unit 112 via connecting feet 20, angle brackets 114 and connecting links 116 according to a second preferred embodiment of the invention. Like reference numerals are used to describe like elements from the preceding embodiment. As can be seen in FIG. 10, reclinable seating unit 110 includes front and rear cross-bars 118 and 120, respectively, to which connecting feet 20 are connected as previously described. Angle brackets 114 are suitably secured, such as by threaded fasteners, to side wall portions 122 and 124 of corner seating unit 112.

As can be seen in FIG. 12, angle brackets 114 are a generally L shaped structural member which is formed to a substantially right angle with an upstanding leg portion 126 and laterally extending leg portion 128. Upstanding leg portion 126 is formed with a plurality of apertures 130 for securing angle bracket 114 to seating units which have neither transverse or longitudinal extending frame members. In such cases, angle brackets may be secured to side wall portions, such as side wall portions 122 and 124 of corner seating unit 112, with laterally extending leg portion 128 protruding outwardly therefrom. Leg portion 128 is formed with an elongated aperture 132 for interconnecting angle bracket 114 with connecting feet 20 or frame rails 18 secured to adjacent seating units to be interconnected by connecting links 22 or, as is shown in FIGS. 10 and 13A–13C, with connecting links 116.

Figures 13A, 13B, 13C, 14:
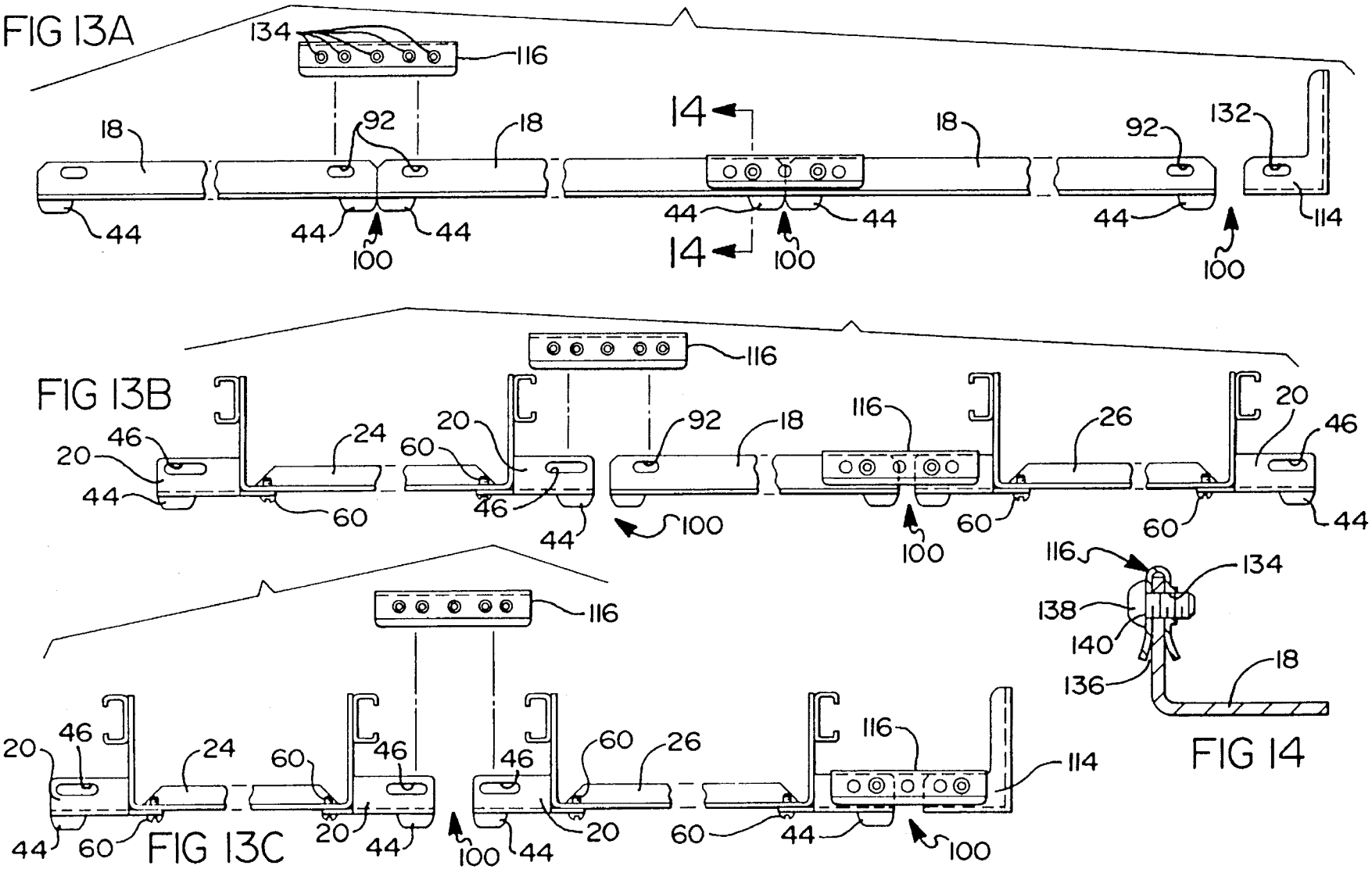
FIGS. 13A–13C are partial schematic front views similar to FIGS. 2A–2C illustrating the interconnection of seating units according to a second preferred embodiment of the invention.
FIG. 14 is a section view taken along line 14—14 of FIG. 13A.

As shown in FIG. 11, connecting link 116 is formed similar to connecting link 22, that is, it has a generally U shaped section with an opening 136 for snugly fitting over connecting feet 20, frame rails 18 or angle brackets 114. In place of tabs 94, however, connecting link 116 is formed with a plurality of extruded, threaded apertures 134 for receiving threaded fasteners 138 and for securing connecting link 116 to connecting feet 20, angle brackets 114 or frame rails 18 (as shown in FIG. 14). The use of threaded fasteners 138 with connecting links 116 provides added clamping force of connecting link 116 to connecting feet 20, frame rails 18 or angle brackets 114 for enhancing the rigid interconnection of seating units and thus the rigid structure of the sofa or loveseat.

With reference to FIGS. 13A–13C, a number of alternative interconnected seating units is schematically illustrated. In FIG. 13A, three seating units adapted with frame rails 18 are shown interconnected and further interconnected to a seating unit adapted with angle bracket 114. FIG. 13B shows the interconnection of seating units adapted with connecting feet 20, frame rails 18 and angle brackets 114. And, similarly, FIG. 13C illustrates the interconnection of seating units adapted with connecting feet 20 and angle brackets 114.

As with the preceding embodiment, the seating units to be interconnected have frame rails 18, connecting feet 20 or angle brackets 114 secured thereto, as described and depending on the type of seating unit, and are aligned adjacent to each other. Connecting links 22 or 116 are then pressed over frame rails 18, connecting feet 20 or angle brackets 114, as described. If connecting links 22 are used, no further assembly is required. If connecting links 116 are used, after positioning connecting links 116 over frame rails 18, connecting feet 20 or angle brackets 116, threaded fasteners 138 are secured through apertures 140 and into threaded apertures 134 thus engaging elongated apertures 46, 92 or 132. As with the preceding embodiment, elongated apertures 46, 92 and 132 formed in connecting feet 20, frame rails 18 and angle brackets 114 provide for adjustment of the relative spacing between adjacent seating units for accommodating varying thicknesses of upholstery, padding, etc. and for preventing excessive gaps between adjacent seating units. In the preferred embodiment, elongate aperture 132 in angle bracket 114 is approximately about ½ inch in length.

From the above it should be apparent that mounting apparatus 10 and 10' of the present invention serve to greatly simplify the ease with which modular sofas may be constructed, disassembled, moved, handled and adjusted. The mounting apparatus 10 and 10' further enable independent seating sections to be quickly and easily replaced with other types of seating sections as the owner desires.

Referring now to FIG. 15, there is shown a modular seating assembly 200 in the form of an L-shaped sofa. The seating assembly 200 includes an end recliner seating section 202, an armless recliner seating section 203, a corner seating section 204 and a fixed end seating section 206. It will be appreciated that while an L-shaped sofa has been illustrated in FIG. 15, that the teachings of the present invention are applicable to a wide variety of modular seating assemblies taking widely varying shapes. For example, the seating assembly 200 shown in FIG. 15 may easily comprise more than one end seating section 206, more than one recliner seating section 202, or more than one armless recliner seating section 203, or may not include the corner seating section 204. As will become more apparent from the following description of the preferred embodiments of the invention, virtually any combination of reclining and fixed seating sections could be releasably, easily and conveniently secured together without the need for special tools.

Referring now to FIG. 16, a pair of bracket members 208 in accordance with one preferred embodiment of the present invention are shown secured to a sidewall 210 of the seating section 206. The sidewall 210 is typically made from plywood and covered with fabric and optionally a small degree of padding. It will also be appreciated that the plywood sidewall 210 could be replaced with a wooden or metal brace-like member extending longitudinally along a bottom edge 212 of the seating section 206. Accordingly, virtually any structurally strong member having good rigidity may be used to support the bracket members 208.

With brief reference to FIGS. 17, **18*a* and 18*b*, the bracket member 208 will now be described in detail. The bracket member 208 comprises a first wall portion 214, a second wall portion 216 and a connecting wall portion 218. The connecting wall portion is integrally formed with the first and second wall portions 214 and 216, respectively, to form a generally inverted, U-shaped bracket. The first wall portion 214 includes a first key-hole like opening 220 and the second wall portion 216 likewise includes a second key-hole like opening 222 which is in general longitudinal alignment with the first key-hole like opening 220. Each of the key-hole like openings 220 and 222 includes an enlarged, generally circular portion 224 and 226, respectively, and a slot portion 228 and 230, respectively, extending radially outwardly of its associated circular portion 224 or 226. With specific reference to FIG. 18, each slot portion 228 and 230 includes a pair of converging side walls 232 extending generally radially outwardly from its respective circular portion 224 or 226. It will be appreciated, however, that a more conventional slot having generally parallel wall portions could also be used in lieu of the converging wall portions 232 if desired. The converging wall portions 232, however, help to provide a slight "wedging" action which helps to maintain the secured seating sections relatively stationary in spite of slight movement of the seating sections which may occur when a person sits down quickly on one or the other of two attached ones of the seating sections 202, 204 or 206**.

Referring now to FIG. 19, the bracket member 208 is shown secured to a portion of the side wall 210 of the end seating section 206, together with a portion of a side wall 234 of the corner seating section 204. The bracket member 208 of the present invention is adapted to be releasably secured to the side wall 210 by a first fastener 236. The first fastener 236 may take a variety of forms but typically includes an elongated threaded shaft portion 238 and a fixed enlarged head portion 240 having a diameter greater than that of the shaft portion 238. A nut 239 is threadably secured to the shaft portion 238 to fixedly secure the first fastener 236 to the sidewall 210. A second fastener 242 also having an elongated, threaded shaft portion 244 extending through an aperture 249 in the sidewall 234 and an enlarged head portion 246 is also secured to the side wall 234 of the corner seating section 204 via a threaded nut 247. The enlarged head portion 246 also has a diameter which is larger than that of the shaft portion 244. Each of the threaded shaft portions 238 and 244 have a diameter which allows a portion thereof to be positioned at least part way into the slot portions 228 and 230, respectively, but which is slightly greater than the width of its associated slot 228 or 230 at the radially outermost end of the slot 228 or 230. Each of the fasteners 236 and 242 may comprise a threaded bolt or other like member which may be secured to its corresponding side wall portion by a threaded nut or other like member. However any form of fastening member includes at least a short shaft portion sufficient to extend through the cross sectional width of one of the wall portions 214 or 216, and which includes some form of enlarged head portion sufficient to prevent the bracket member 208 from being removed from the side wall 210 or 234 once the head portion is engaged within one or the other of the slots 228 or 230, may just as easily be used. As an example, a pair of rivets could be used as the fasteners to engage the bracket member 208. The use of threaded fasteners provide a degree of adjustability, however, which would be more difficult to achieve with rivets. This advantage of the threaded fasteners 236 and 242 will be discussed in greater detail in connection with the operation of the bracket member 208.

Referring now to FIGS. 19 and 20, a description of the assembly of the seating sections 204 and 206 will be provided. With initial reference to FIG. 19, the bracket member 208 is first secured to the side wall 210 of the end seating section 206 by the first fastener 236. To accomplish this the first fastener 236 is inserted through an aperture 248 in the side wall 210 of the end seating section 206. The first fastener 236 is secured to the side wall 210 by the threaded nut 239. The first fastener 236 has an overall length sufficient to allow the head portion 240 thereof to protrude generally perpendicularly outwardly of the side wall 210 by at least about 0.125 inch–250 inch and, in any event, slightly more than the cross sectional thickness of the first wall portion 214 of the bracket member 208. The bracket member 208 is then placed over the head portion 240 of the fastener 236 such that the head portion 240 extends through the key-hole opening 220 in the first wall portion 214. The bracket member 208 is then manually urged downwardly to cause a portion of the shaft portion 238 to engage within the slot 228 and to be wedged therein. If a threaded nut is included for use with the first fastener 236, then this nut can be tightened at this time to even more fixedly secure the bracket member 208 to the side wall 210.

Either before or after securing the bracket member 208 to the side wall 210 of the end seating section 206, the second fastener 242 is secured to the side wall 234 of the corner seating section 204. The second fastening member 242 is secured such that the enlarged head portion 246 extends generally perpendicularly outwardly of the side wall 234 by a distance at least slightly greater than the cross sectional thickness of the second wall portion 216, and typically by about 0.125 inch–0.250 inch.

The corner seating section 204 is secured to the end seating section 206 by positioning the side wall 234 such that the enlarged head portion 236 of the fastener 242 extends through the key-hole like opening 222 in the second wall portion 216. The seating section 204 is then moved laterally of the end seating section 206 in accordance with directional arrow 252 such that a portion of the shaft portion 244 is urged into the slot 230 in the second wall portion 216. This portion of the shaft portion 244 thus becomes wedgingly engaged within the slot 230 and the enlarged head portion 242, being of a diameter greater than the maximum width of the slot 230, prevents the second fastener 242 from being disengaged from the bracket member 208. At this point the bracket member 208 prevents further lateral movement of the seating sections 204 and 206 relative to one another. If two bracket members 208 are used, as illustrated in FIG. 16, which is anticipated to be the preferred number of bracket members 208 used to secure two adjacent seating sections, then both bracket members 208 are first secured to one of the seating sections 204 or 206 and two fasteners are secured to the opposite seating section before securing the two seating sections 204 and 206 together. The engagement of the fastening members 236 and 232 with the bracket member is shown in FIG. 20.

After the seating sections 204 and 206 have been secured together, the second fastener 242 may optionally be tightened further via the threaded nut 247. If one or the other of the threaded nuts 239,247 of either fastener 236 or 242 are tightened after the two seating sections 204 and 206 are secured together, then it will most likely be necessary to loosen one or the other, or possibly both, prior to attempting to uncouple one of the seating sections 204 or 206 from the other. If these nuts 239,247 are not tightened after the seating sections 204 and 206 are secured together, then it may be possible to move one or the other of the seating sections 204 and 206 laterally of and away from the other to uncouple one of the other of the fastening members 236,242 from the bracket member 208.

From the above discussion it will be appreciated that the length of the connecting wall portion 218 (FIG. 19) must be sufficient to allow both of the head portions 240 and 246 of the fasteners 236 and 242, respectively, to protrude into the interior area bounded by the wall portions 214 and 216 and the connecting wall portion 218. Also, consideration must be paid to the positioning of the fastening members 236 and 242 in their respective side walls 210 and 234 such that when the seating sections 204 and 206 are releasably secured together the seating sections 204 and 206 will be laterally aligned with one another such that their seating surfaces are approximately level and the seating sections are aligned front-to-back to form the appearance of a single-piece sofa. Also, the thickness of the fabric disposed on the sidewalls 210 and 234 and any padding underneath the fabric must also be taken into account in determining the amount by which each of the fastening members 236 and 242 is set to protrude outwardly of its associated side wall 210 and 234, respectively. Other factors such as the type of seat cushions used with each of the seating sections 204 and 206 may also affect how far each of the fastening members 236 and 242 is optionally set to extend outwardly of their respective side walls 210 and 234 before the seating sections 204 and 206 are secured together.

Referring now to FIG. 21, a bracket member 258 in accordance with an alternative preferred embodiment of the present invention is shown. The bracket member 258 also includes a first side wall portion 260 having a key-hole like opening 262, a second wall portion 264 having a second key-hole like opening 266 and a connecting wall portion 268 which is integrally formed with the first wall portion 260 and the second wall portion 264. The first key-hole like opening 262 includes an enlarged, generally circular portion 270 and a slot portion 272 and the second key-hole like opening 266 includes an enlarged, generally circular portion 274 and a slot portion 276. The key-hole like openings 262 and 266 are identical in shape to the key-hole like openings 220 and 222 shown in FIGS. 17–19. The principal difference between the bracket member 258 and the bracket member 208 is that the first and second wall portions 260 and 264 diverge from one another away from the connecting wall portion 268, as indicated by angle 277, to form an inverted V-shaped bracket member. This V-shape allows one of the fastening members 236 and 242 shown in FIGS. 19 and 20 to be urged slightly towards the other when one of the seating sections 204 or 206 is urged laterally of the other during assembly. In this manner a slight "tightening" action occurs as the two seating sections are releasably secured together to even more securely hold the seating sections 204 and 206 together.

Referring now to FIGS. 22–25, yet another bracket member 278 in accordance with another alternative preferred embodiment of the present invention is shown. The bracket member 278 is particularly well adapted to be secured to an existing frame rail 280, such as that shown in FIG. 22, which is typically used in connection with recliner seating sections such as seating sections 202 and 203. Since typically two frame rails 280 are used with each recliner seating section, these rails provide extremely sturdy members to which the bracket members 278 may be easily and conveniently secured. In FIG. 22 two of the bracket members 278 have been shown secured to opposite ends of the frame rail 280 to illustrate that the bracket members are well adapted to secure an armless recliner seating section 203 in between two adjacent fixed or recliner seating sections.

With specific reference to FIGS. 22–24, the bracket member 278 includes a first wall portion 282, a second wall portion 284 extending generally perpendicularly of the first wall portion 282, and a reinforcing wall portion 285. The first wall portion 282 includes a key-hole like opening 286 having a slot portion 287. The shape of this opening is identical to the key-hole openings 220 and 222 shown in FIGS. 17–20. The second wall portion 284 includes an opening in the form of an elongated slot 288, as shown particularly well in FIG. 25. Elongated slot 288 is sized to receive a threaded foot member 290 (FIG. 22) which is used to secure the bracket member 278 to the frame rail 280, as well as to adjust the height of the front of the recliner seating section 203 relative to a surface upon which it rests. Once secured to the recliner seating section 203, the bracket member 278 fits over a corner of the frame rail 280 of the seating section 203 and is positioned such that the first wall portion 282 is spaced from a side wall 292 of the recliner seating section 203 by a distance sufficient to allow the enlarged head portion of a fastener such as that shown in FIG. 17 to extend through the key-hole like opening 286 and engage within the slot portion 287 of the opening 286. Since two rails such as frame rails 280 are typically included with each recliner seating section 203, one being disposed along a front edge 294 of the seating section 203 and one along a rear edge 296, it is anticipated that, most preferably, two of the bracket members 278 will be disposed on each side of the recliner seating section 203 at the outermost ends of each of the frame rails thereof. Once secured to the frame rail 280, the process of coupling the bracket member 278 to an adjacent seating section is identical to that described in connection with FIGS. 19 and 20.

Figure 26:
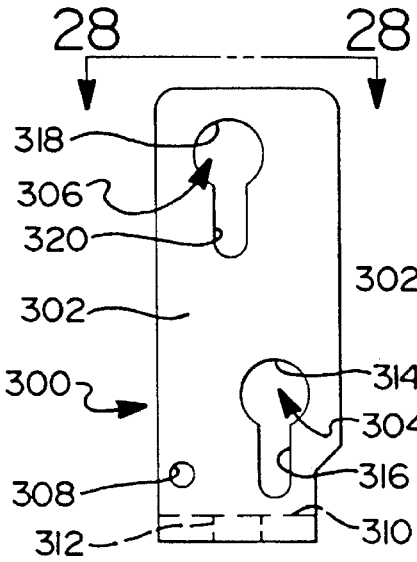
FIG. 26 is a front view of an alternative preferred embodiment of the bracket member of the present invention.
Figure 27:
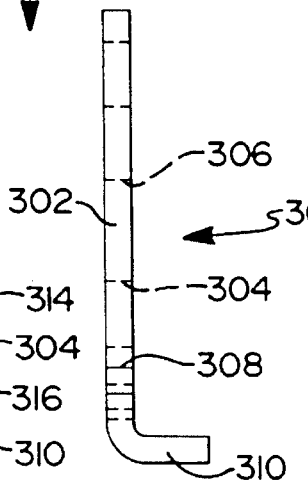
FIG. 27 is a side view of the bracket member of FIG. 26.
Figure 28:
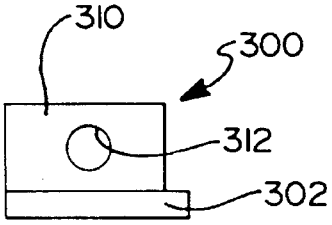
FIG. 28 is a top view of the bracket member of FIG. 26 in accordance with directional line 28—28 in FIG. 26.
Figure 29:
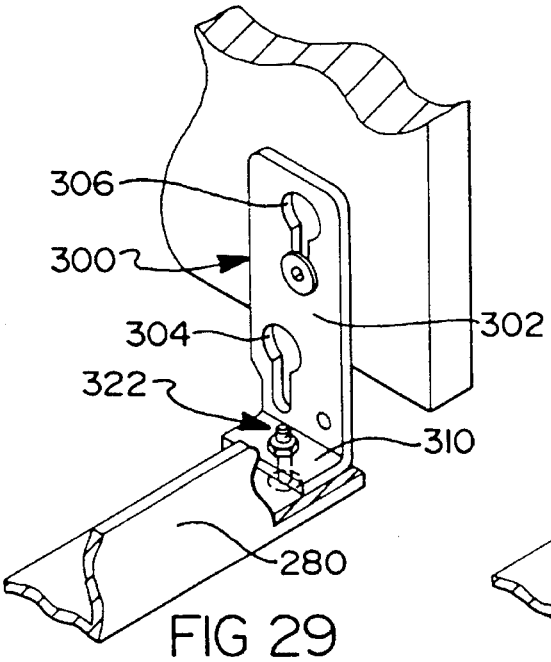
FIG. 29 is a view of the bracket member of FIGS. 26–28 being used to secure a frame rail of a recliner seating section to a sidewall of a fixed seating section.

Referring now to FIGS. 26–28, a universal bracket member 300 in accordance with yet another alternative preferred embodiment of the present invention is shown. The bracket member 300 is especially well suited for use with recliner seating sections which incorporate a frame rail member such as frame rail member 280 shown in FIG. 22. The bracket member 300 includes a wall portion 302 having a first, or lower, key-hole like opening 304 and a second, or upper, key-hole like opening 306 formed therein. The first wall portion 302 further includes a threaded aperture 308, the function of which will be described momentarily. Integrally formed with the first wall portion 302 is a second wall portion 310 extending generally perpendicularly therefrom. The second wall portion 310 includes an opening 312 formed therein. The lower key-hole like opening 304 includes a generally circular portion 314 and a slot portion 316 extending radially outwardly from the generally circular portion 314. Identically, the key-hole like opening 306 includes a generally circular portion 318 and a slot portion 320 extending radially outwardly of the circular portion 318. It will be noted that the walls of the slot portions 316 and 320 include generally parallel disposed wall portions rather than the converging wall portions 232 of the bracket member 208. It will be appreciated, however, that the wall portions of the slots 316 and 320 could just as well be formed in a converging fashion if so desired.

The universal bracket member 300 provides the added advantage of not being restricted to placement on one side or the other of the frame rails (such as frame rail 280 in FIG. 22) used in connection with reclining seating sections. When installing the bracket member 300, the second wall portion 310 is secured to the frame rail 280 by a suitable fastener which is placed through the opening 312. The upper key-hole like opening 306 can then be used with a fastener such as fastener 236 or 242 to secure the first wall portion 302 to the sidewall of an adjacent, fixed seating section.

Figure 30:
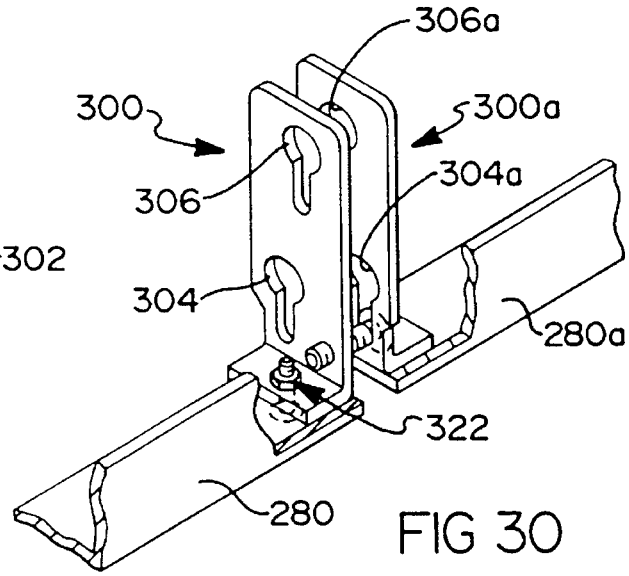
FIG. 30 is a view of a pair of the bracket members shown in FIGS. 26–28 being used to couple the frame rails of adjacent recliner seating sections together.

Referring now to FIG. 30, a pair of bracket members 300 can also be used to secure a recliner seating section to another recliner seating section. In this instance a first bracket member 300 is secured to the frame rail 280 of a first recliner seating section by fastener 322. A second identical bracket member **300*a* is secured to a frame rail 280*a* of an adjacent recliner seating section in identical fashion to that of the first bracket member 300. A fastener such as fastener 236 or 242 is then used to threadably engage the threaded aperture 308 of the first bracket member 300, and the lower and upper key-hole opening 306*a* of the second bracket member 300*a* is used to engage the enlarged head portion of the fastener. In this matter two recliner seating sections can be easily and quickly secured together with identical bracket members. It will be noted that the placement off longitudinal center of the lower key-hole like opening 304 and the threaded aperture 308** make this possible.

It will also be noted that the key-hole like openings 304 and 306 shown in FIGS. 26 have been inverted 180 degrees from the key-hole like openings 220 and 222 shown in FIGS. 17, **18*a* and 18*b*. However, the orientation of the key-hole like openings 304 and 306 could just as well be inverted 180 degrees provided the fastening members of the adjacent seating section to be secured thereto are positioned on the side wall of the adjacent seating section at suitable positions sufficient to cause engagement of the fastening members within the slot portions 316 and 320 when the two seating sections are moved laterally of one another slightly to secure them to the bracket member 300**.

Figure 31:
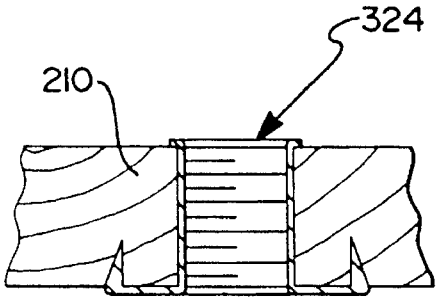
FIG. 31 is a side cross sectional view of a crimp lock rivet T-nut which may be used to help secure the fasteners to the sidewalls of fixed seating sections.

With regard to fasteners 236 and 242 described herein, in the preferred embodiments a commercially available and well known crimp lock rivet T-nut 324, as shown in FIG. 31, is preferably secured to the sidewall of the fixed seating section(s). Since this T-nut 324 is internally threaded, the fastener can be easily threadably engaged to the proper degree, and will be maintained at this position during the assembly process.

From the above discussion it should be appreciated that the preferred embodiments of the present invention described herein provide a very quick, easy and convenient means by which two seating sections of a modular seating assembly such as a modular sofa can be quickly and easily secured releasably together. The preferred embodiments further do not require the use of special tools or extensive training in order to implement. Accordingly, the individual seating sections of the modular seating assembly can be quickly and easily secured together once the individual sections are delivered to a home, office, etc., by relatively unskilled personnel, and further allow for quick disassembly of the modular seating assembly if same is to be moved for any reason. The specific construction of the preferred embodiments enables each to be manufactured relatively simply from widely available materials, such as metal, from widely available manufacturing techniques and provides the added benefit of not adding appreciably to the overall cost of the modular seating assembly.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for securing a first and second independent modular seating section of a modular sofa assembly together, wherein the first seating section includes a first side wall and the second seating section includes a second side wall, said apparatus comprising:

bracket means for interdisposing between the first side wall and the second side wall, said bracket means including a first wall portion having a closed key-hole like opening formed therein and a second wall portion having an opening formed therein;

a first fastening member for securing said second wall portion to the first side wall; and a second fastening member for securement to the second side wall, said second fastening member including a shaft portion and an enlarged head portion having a greater diameter than said shaft portion;

whereby when the first seating section is positioned closely adjacent the second seating section said second fastener member is caused to extend into said closed key-hole like opening and releasably secure together the first and second seating sections.

2. The apparatus of claim 1, wherein said first wall portion includes a pair of closed key-hole like openings formed therein;

wherein said first fastening member further includes a frame rail secured to said first side wall of a reclining seating section; and wherein said second wall portion protrudes generally perpendicularly of said first wall portion and is adapted to be secured to said frame rail.

3. The apparatus of claim 1, wherein said second wall portion extends generally parallel to said first wall portion; and wherein said apparatus further includes a connecting wall portion for connecting said first and second wall portions in the shape of a generally inverted U-shaped bracket.

4. The apparatus of claim 1, further including an aperture formed in said first wall portion for engaging with a stud portion of a frame rail member of a recliner seating section to thereby help prevent movement of said bracket means relative to said frame rail member.

5. An apparatus for securing a first and second independent modular seating section of a modular sofa assembly together, wherein the first seating section includes a first side wall and the second seating section includes a second side wall, said apparatus comprising:

first fastener means having a shaft portion and an enlarged head portion, said first fastener means for securement to the first side wall and protruding outwardly therefrom;

second fastener means having an elongated shaft portion and an enlarged head portion, said second fastener means for securement to the second side wall and protruding outwardly therefrom, the second side wall being adapted to be disposed closely adjacent the first side wall when the first and second modular seating sections are assembled together to form the modular sofa assembly; and bracket means for interdisposing between the first side wall and the second side wall for securing the first and second modular seating sections together, said bracket means including:

a first wall portion;

a first closed key-hole like opening formed in said first wall portion and being adapted to receive said enlarged head portion of said first fastener means therethrough such that said bracket means is releasably secured to said first fastener means;

a connecting wall portion extending from said first wall portion;

a second wall portion extending from said connecting wall portion; and a second closed key-hole like opening formed in said second wall portion, said second key-hole like opening receiving therethrough said enlarged head portion of said second fastener means when the second side wall is positioned closely adjacent the first side wall, to thereby releasably lock the first and second modular seating sections together.

6. The apparatus of claim 5, wherein said bracket means comprises an inverted U-shaped bracket.

7. The apparatus of claim 5, wherein said first and second key-hole like openings are positioned in longitudinal alignment with one another.

8. The apparatus of claim 7, wherein each of said first and second key-hole like openings comprises an enlarged, generally circular portion; and a slot portion having converging wall portions extending radially outwardly from said generally circular portion.

9. The apparatus of claim 8, wherein said slot portion of each one of said first and second key-hole like openings has a width sufficient to enable said shaft portion of each one of said first and second fastening means to pass therethrough but which is smaller than a diameter of said enlarged head portion of each one of said first and second fastener means.

10. For a modular sofa assembly including at least one fixed seating section and at least one recliner seating section, wherein said fixed seating section has a side wall portion and said recliner seating section has at least one frame rail, and wherein at least an end portion of said frame rail and said side wall portion are in close proximity to one another when said recliner seating section and said fixed seating section are disposed in position to form said modular sofa assembly, a bracket member for releasably coupling said recliner seating section and said fixed seating section together when said seating sections are positioned closely adjacent one another, to thereby form said modular sofa assembly, said bracket member comprising:

a first wall portion;

a closed key-hole like opening disposed in said first wall portion;

a second wall portion extending generally perpendicularly relative to said first wall portion;

a connecting wall portion integrally formed with said first and second wall portions and extending generally perpendicular to each of said first and second wall portions, whereby said first wall portion, said second wall portion and said connecting wall portion are orthogonal;

an opening formed in said second wall portion, said second wall portion further being adapted to be positioned on said frame rail;

first fastening means including an elongated shaft and an enlarged head portion having a diameter greater than said elongated shaft for securement to said side wall portion of said fixed seating section and protruding outwardly of said side wall portion;

second fastening means adapted to extend through said opening in said second wall portion to couple said second wall portion to said frame rail; and whereby said bracket member, when coupled to said frame rail, may be secured to said first fastening means by positioning said recliner seating section such that said enlarged head portion of said first fastening means passes through said key-hole like opening and releasably engages with said key-hole like opening.

11. The bracket member of claim 10, wherein said key-hole like opening comprises an enlarged, generally circular portion having a diameter greater than said enlarged head portion of said first fastener means; and a slot having converging wall portions, said slot extending generally radially outwardly of said circular portion, said slot being adapted to receive a portion of said shaft of said first fastener means to releasably lockably couple said first wall portion of said bracket member to said first fastener means, and thereby to releasably couple said recliner seating section closely adjacent said side wall portion of said fixed seating section.

12. The bracket member of claim 11, wherein said opening in said second wall portion comprises an elongated slot to enable said bracket member to be adjustably positioned on said frame rail.

13. A bracket member for releasably securing a first modular seating section and a second modular seating section together to form a modular sofa assembly, wherein said first modular seating section has a first side wall and said second modular seating section has a second side wall, said bracket member comprising:

a first wall portion;

a connecting wall portion integrally formed with said first wall portion and protruding generally perpendicularly therefrom;

a second wall portion integrally formed with said connecting wall portion and protruding generally perpendicularly therefrom, said first wall portion, said connecting wall portion and said second wall portion forming a generally inverted U-shaped configuration;

said first wall portion having a first closed key-hole like opening therein, said first key-hole like opening including an enlarged, generally circular portion and a slot extending generally radially outwardly from said circular portion;

said second wall portion having a second closed key-hole like opening formed therein, said second key-hole like opening including an enlarged, generally circular portion and a slot extending generally radially outwardly from said circular portion, said first and second key-hole like openings further being generally longitudinally aligned with one another;

first fastening means having an elongated shaft and an enlarged head portion having a diameter greater than said elongated shaft portion and being securable to the first side wall of the first modular seating section;

second fastening means having an elongated shaft portion and an enlarged head portion and being securable to the second side wall of the second modular seating section, each one of said first and second fastening means protruding generally outwardly of its associated first and second side wall;

said shaft portion of said first fastening means being adapted to extend through said circular portion of said key-like opening in said first wall portion and within said slot of said first key-hole like opening such that said enlarged head portion engages said first wall portion to secure said bracket member to said side wall of the first modular seating section; and said shaft portion of said second fastening means being adapted to extend through said circular portion of said second key-hole like opening in said second wall portion and into said slot of said second key-hole like opening such that said enlarged head portion of said second fastening means engages said second wall portion to secure said second wall portion to said side wall of the second modular seating section.

* * * * *

UNITED STATES PATENT AND TRADEMARK OFFICE

CERTIFICATE OF CORRECTION

PATENT NO. : 5,544,938

DATED : August 13, 1996

INVENTOR(S) : Jonathan R. Saul, et al.

It is certified that error appears in the above-indentified patent and that said Letters Patent is hereby corrected as shown below:

Column 5, line 23
"In" should be -- in --.

Column 7, line 4,
"preferable" should be -- preferably --.

Column 11, line 34,
"250" should be -- .250 --.

Column 11, line 58,

"236" should be -- 246 --.

Column 11, line 66,

"242" should be -- 246 --.

Column 14, line 35,

"opening" should be -- openings --.

UNITED STATES PATENT AND TRADEMARK OFFICE

CERTIFICATE OF CORRECTION

PATENT NO. : 5,544,938

DATED : August 13, 1996

INVENTOR(S) : Jonathan R. Saul, et al.

It is certified that error appears in the above-indentified patent and that said Letters Patent is hereby corrected as shown below:

Column 14, line 35, after "openings" insert -- 304a and --.

Column 14, line 43, (Application page 31, line 18); "FIGS." should be -- FIG. --.

Signed and Sealed this

Third Day of December, 1996

*Attest:*

*Attesting Officer*

Bruce Lehman

BRUCE LEHMAN

*Commissioner of Patents and Trademarks*